US011016427B1

(12) United States Patent
Hara et al.

(10) Patent No.: US 11,016,427 B1
(45) Date of Patent: May 25, 2021

(54) HEATING DEVICE, FIXING DEVICE, AND IMAGE FORMING APPARATUS

(71) Applicant: FUJI XEROX CO., LTD., Tokyo (JP)

(72) Inventors: Toko Hara, Kanagawa (JP); Toru Inoue, Kanagawa (JP); Toshiyuki Miyata, Kanagawa (JP); Kazuyoshi Itoh, Kanagawa (JP); Kiyoshi Koyanagi, Kanagawa (JP); Sou Morizaki, Kanagawa (JP); Motoharu Nakao, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/926,772

(22) Filed: Jul. 12, 2020

(30) Foreign Application Priority Data

Mar. 27, 2020 (JP) ..... JP2020-058323

(51) Int. Cl.
*G03G 15/20* (2006.01)

(52) U.S. Cl.
CPC ..... *G03G 15/2053* (2013.01); *G03G 15/2039* (2013.01); *G03G 15/2042* (2013.01); *G03G 15/2064* (2013.01); *G03G 2215/2038* (2013.01)

(58) Field of Classification Search
CPC ..... G03G 15/2039; G03G 15/2042; G03G 15/2053; G03G 15/2064; G03G 2215/2038
See application file for complete search history.

(56) References Cited

U.S. PATENT DOCUMENTS

| | | | | |
|---|---|---|---|---|
| 5,300,996 A * | 4/1994 | Yokoyama | G03G 15/2053 219/216 |
| 8,068,758 B2 | 11/2011 | Kaji | |
| 8,218,993 B2 | 7/2012 | Kaji | |
| 2010/0034568 A1* | 2/2010 | Sone | G03G 15/2042 399/331 |

FOREIGN PATENT DOCUMENTS

| | | |
|---|---|---|
| JP | 05289555 | 11/1993 |
| JP | 2013-142834 | 7/2013 |
| JP | 5258386 | 8/2013 |

* cited by examiner

*Primary Examiner* — Hoang X Ngo
(74) *Attorney, Agent, or Firm* — JCIPRNET

(57) ABSTRACT

A heating device includes a surface heater unit including a heater portion that generates heat in a region extending in a longitudinal direction, the surface heater unit heating a heating object; a support unit that supports the surface heater unit; and a heat conducting unit disposed in contact with a surface of the surface heater unit at a side opposite to a side adjacent to the heating object in a region between a center of the heater portion in a direction crossing the longitudinal direction and the support unit.

9 Claims, 8 Drawing Sheets

HEATING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2020-058323 filed Mar. 27, 2020.

BACKGROUND i) Technical Field

The present disclosure relates to a heating device, a fixing device, and an image forming apparatus.

ii) Related Art

Technologies regarding a heating device and a fixing device have been proposed in, for example, Japanese Unexamined Patent Application Publication No. 5-289555, Japanese Unexamined Patent Application Publication No. 2013-142834, and Japanese Patent No. 5258386.

Japanese Unexamined Patent Application Publication No. 5-289555 describes a structure including a highly heat-conductive member having a thermal conductivity of greater than or equal to 100 [kcal/mhr° C.] on a heating body at a side opposite to a contact surface that is in contact with a fixing film.

Japanese Unexamined Patent Application Publication No. 2013-142834 describes a structure including a substrate composed of a plate-shaped heat pipe. Heating elements are printed on the substrate with an insulating layer provided between the substrate and each heater element, and the outermost surface is coated with an insulating layer.

Japanese Patent No. 5258386 describes a structure including a heating source having plural heater elements with different heat generation distributions in a longitudinal direction orthogonal to a direction in which a recording material is transported. The heat generation distributions may be changed by changing the energization ratio between the heater elements. When a cooling fan is in operation, a controller controls energization of the heating source so that the amount of heat generated in a region in the longitudinal direction that corresponds to a cooling region cooled by the cooling fan is greater than that before the start of the cooling operation.

SUMMARY

Aspects of non-limiting embodiments of the present disclosure relate to a configuration for reducing both a temperature increase at the ends of a surface heater unit in a longitudinal direction and a temperature increase time after the start of a heating process compared to when a highly heat-conductive member is provided on the surface heater unit over the entire area thereof at a side opposite to a contact surface that is in contact with a heating object.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a heating device including a surface heater unit including a heater portion that generates heat in a region extending in a longitudinal direction, the surface heater unit heating a heating object; a support unit that supports the surface heater unit; and a heat conducting unit disposed in contact with a surface of the surface heater unit at a side opposite to a side adjacent to the heating object in a region between a center of the heater portion in a direction crossing the longitudinal direction and the support unit.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will now be described with reference to the drawings.

First Exemplary Embodiment

Figure 1:
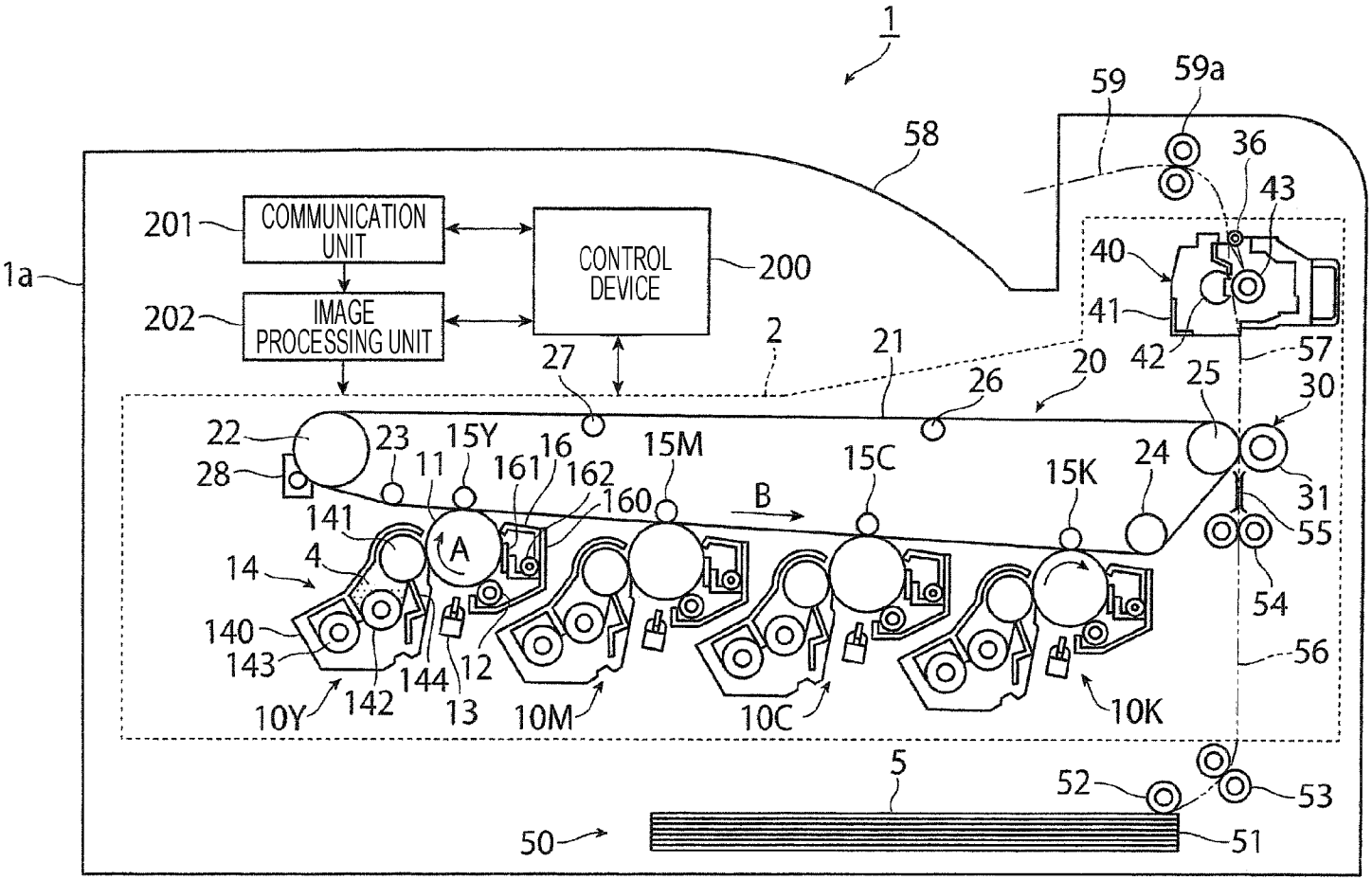
FIG. 1 illustrates the overall structure of an image forming apparatus including a fixing device according to a first exemplary embodiment of the present disclosure.

FIG. 1 illustrates an image forming apparatus 1 including a fixing device according to a first exemplary embodiment.

Overall Structure of Image Forming Apparatus

The image forming apparatus 1 according to the first exemplary embodiment is, for example, a color printer. The image forming apparatus 1 includes plural image forming devices 10, an intermediate transfer device 20, a sheet feeding device 50, and a fixing device 40. Each image forming device 10 forms a toner image by using toner contained in developer 4. The intermediate transfer device 20 carries the toner images formed by the image forming devices 10 and transports the toner images to a second transfer position, at which the toner images are transferred onto a recording paper sheet 5, which is an example of a recording medium, in a second transfer process. The sheet feeding device 50 stores recording paper sheets 5 to be supplied to the second transfer position of the intermediate transfer device 20, and transports each recording paper sheet 5. The fixing device 40 fixes the toner images that have been transferred onto the recording paper sheet 5 by the intermediate transfer device 20 in the second transfer process. The image forming devices 10 and the intermediate transfer device 20 constitute an image formation unit 2 that forms an image on the recording paper sheet 5. Referring to FIG. 1, the image forming apparatus 1 includes an apparatus body 1*a*. The apparatus body 1*a* is formed of, for example, a support structure and an outer covering. The two-dot chain line in FIG. 1 shows a transport path along which the recording paper sheet 5 is transported in the apparatus body 1*a*.

The image forming devices 10 include four image forming devices 10Y, 10M, 10C, and 10K, which exclusively form a yellow (Y) toner image, a magenta (M) toner image, a cyan (C) toner image, and a black (K) toner image, respectively. The four image forming devices 10 (Y, M, C, and K) are arranged along an inclined line in the apparatus body 1*a*.

The four image forming devices 10 include yellow (Y), magenta (M), and cyan (C) color image forming devices 10 (Y, M, and C) and a black (K) image forming device 10K. The black image forming device 10K is disposed at the most downstream position in a direction B in which an intermediate transfer belt 21 included in the intermediate transfer device 20 is moved. The image forming apparatus 1 has a full-color mode and a black-and-white mode as image forming modes thereof. In the full-color mode, the color image forming devices 10 (Y, M, and C) and the black (K) image forming device 10K are operated to form a full-color image. In the black-and-white mode, only the black (K) image forming device 10K is operated to from a black-and-white (monochrome) image.

As illustrated in FIG. 1, each of the image forming devices 10 (Y, M, C, and K) includes a rotating photoconductor drum 11, which is an example of an image carrier, and devices arranged around the photoconductor drum 11 as examples of toner-image-forming units. These devices include a charging device 12, an exposure device 13, a developing device 14 (Y, M, C, K), a first transfer device 15 (Y, M, C, K), and a drum cleaning device 16 (Y, M, C, K). The charging device 12 charges a peripheral surface (image carrying surface) of the photoconductor drum 11, which allows an image to be formed thereon, to a certain potential. The exposure device 13 forms an electrostatic latent image (of the corresponding color) having a potential difference by irradiating the charged peripheral surface of the photoconductor drum 11 with light based on image information (signal). The developing device 14 (Y, M, C, K) develops the electrostatic latent image into a toner image by using the toner contained in the developer 4 of the corresponding color (Y, M, C, K). The first transfer device 15 (Y, M, C, K) is an example of a first transfer unit that performs a first transfer process in which the toner image is transferred to the intermediate transfer device 20. The drum cleaning device 16 (Y, M, C, K) cleans the image carrying surface of the photoconductor drum 11 by removing residual toner and other deposits from the image carrying surface after the first transfer process.

The photoconductor drum 11 is obtained by forming an image carrying surface having a photoconductive layer made of a photosensitive material (photosensitive layer) on a peripheral surface of a hollow or solid cylindrical base material that is grounded. This photoconductor drum 11 is supported so as to be rotatable in the direction of arrow A when power is transmitted thereto from a driving device (not shown).

The charging device 12 includes a contact charging roller that is arranged in contact with the photoconductor drum 11. A charging voltage is applied to the charging device 12. In the case where the developing device 14 performs a reversal development, a voltage having the same polarity as the polarity to which the toner supplied from the developing device 14 is charged is supplied as the charging voltage. The charging device 12 may instead be a non-contact charging device, such as a scorotron, which is arranged so as not to be in contact with the surface of the photoconductor drum 11.

The exposure device 13 is an LED print head including plural light emitting diodes (LEDs), which serve as light emitting elements, arranged in the axial direction of the photoconductor drum 11. The LED print head forms an electrostatic latent image by irradiating the photoconductor drum 11 with light corresponding to the image information emitted from the LEDs. The exposure device 13 may be configured to perform deflection scanning so that the photoconductor drum 11 is scanned with laser light that corresponds to the image information in the axial direction.

The developing device 14 (Y, M, C, K) includes a developing roller 141, two stirring transport members 142 and 143, and a layer-thickness regulating member 144, which are disposed in a housing 140 having an opening and a storage chamber for the developer 4. The developing roller 141 carries the developer 4 and transports the developer 4 to a developing region in which the developing roller 141 faces the photoconductor drum 11. The stirring transport members 142 and 143 are, for example, screw augers that transport the developer 4 while stirring the developer 4 so that the developer 4 passes the developing roller 141. The layer-thickness regulating member 144 regulates the amount (layer thickness) of the developer 4 carried by the developing roller 141. A developing voltage is applied between the developing roller 141 of the developing device 14 and the photoconductor drum 11 by a power supply device (not shown). The developing roller 141 and the stirring transport members 142 and 143 receive power from the driving device (not shown) and rotate in certain directions. The developers 4 (Y, M, C, and K) of the four colors are each a two-component developer containing non-magnetic toner and magnetic carrier.

The first transfer device 15 (Y, M, C, K) is a contact transfer device including a first transfer roller that rotates while being in contact with the periphery of the photoconductor drum 11 with the intermediate transfer belt 21 interposed therebetween and to which a first transfer voltage is supplied. The first transfer voltage is a direct-current voltage having a polarity opposite to the polarity to which the toner is charged, and is supplied by the power supply device (not shown).

The drum cleaning device 16 includes a container body 160 that has an opening, a cleaning plate 161, and a transport member 162. The cleaning plate 161 is pressed against the peripheral surface of the photoconductor drum 11 at a certain pressure after the first transfer process, and cleans the peripheral surface by removing residual toner and other deposits therefrom. The transport member 162 is, for example, a screw auger that collects the deposits, such as toner, removed by the cleaning plate 161 and transports the collected deposits toward a collection system (not shown).

The cleaning plate 161 is, for example, a plate-shaped member (for example, a blade) made of a material such as rubber.

As illustrated in FIG. 1, the intermediate transfer device 20 is disposed above the image forming devices 10 (Y, M, C, and K). The intermediate transfer device 20 includes an intermediate transfer belt 21, plural belt support rollers 22 to 27, a second transfer device 30, and a belt cleaning device 28. The intermediate transfer belt 21 rotates in the direction of arrow B while passing through first transfer positions, which are positions between the photoconductor drums 11 and the first transfer devices 15 (first transfer rollers). The belt support rollers 22 to 27 retain the intermediate transfer belt 21 in a desired state and support the intermediate transfer belt 21 in a rotatable manner at the inner surface of the intermediate transfer belt 21. The second transfer device 30 is disposed so as to oppose the outer peripheral surface (image carrying surface) of a portion of the intermediate transfer belt 21 that is supported by the belt support roller 25. The second transfer device 30 is an example of a second transfer unit that performs a second transfer process in which the toner images on the intermediate transfer belt 21 are transferred onto the recording paper sheet 5. The belt cleaning device 28 cleans the outer peripheral surface of the intermediate transfer belt 21 by removing residual toner, paper dust, and other deposits from the outer peripheral surface of the intermediate transfer belt 21 after the intermediate transfer belt 21 has passed the second transfer device 30.

The intermediate transfer belt 21 may be, for example, an endless belt made of a material obtained by dispersing a resistance adjuster, such as carbon black, into a synthetic resin, such as a polyimide resin or a polyamide resin. The belt support roller 22 is a driving roller that is rotated by a driving device (not shown) and that serves as an opposing roller that opposes the belt cleaning device 28. The belt support roller 23 serves as a surface positioning roller that enables the intermediate transfer belt 21 to form an image forming surface. The belt support roller 24 serves as a tension-applying roller that applies a tension to the intermediate transfer belt 21. The belt support roller 25 serves as an opposing roller that opposes the second transfer device 30. The belt support rollers 26 and 27 serve as driven rollers that are rotated by the intermediate transfer belt 21.

Referring to FIG. 1, the second transfer device 30 is a contact transfer device including a second transfer roller 31 to which a second transfer voltage is applied and that rotates while being in contact with the peripheral surface of the intermediate transfer belt 21 at a second transfer position. The second transfer position is the position of the outer peripheral surface of the portion of the intermediate transfer belt 21 that is supported by the belt support roller 25 of the intermediate transfer device 20. The second transfer voltage is a direct-current voltage having a polarity that is the same as or opposite to the polarity to which the toner is charged, and is supplied to the second transfer roller 31 or the belt support roller 25 of the intermediate transfer device 20 by the power supply device (not shown).

The fixing device 40 includes a belt-shaped heating rotating body 42 and a roller-shaped pressing rotating body 43, which are disposed in a housing 41 having an inlet and an outlet for the recording paper sheet 5. The heating rotating body 42 rotates counterclockwise and is heated by a heating unit so that the surface temperature thereof is maintained at a predetermined temperature. The pressing rotating body 43 extends substantially along the heating rotating body 42 in the axial direction thereof and is rotated while being pressed against the heating rotating body 42 at a predetermined pressure. A contact section in which the heating rotating body 42 and the pressing rotating body 43 of the fixing device 40 are in contact with each other serves as a fixing process section in which a certain fixing process (heating and pressing) is performed. The fixing device 40 will be described in detail below.

The sheet feeding device 50 is disposed below the image forming devices 10 (Y, M, C, and K). The sheet feeding device 50 includes a sheet container 51 (or plural sheet containers 51) that contains the recording paper sheets 5 of the desired size, type, etc., in a stacked manner, and a feeding device 52 that feeds the recording paper sheets 5 one at a time from the sheet container 51. The sheet container 51 is, for example, attached to the apparatus body 1*a* so as to be capable of being pulled out of the apparatus body 1*a* at the front side thereof that faces the user when the user operates the apparatus.

Examples of the recording paper sheets 5 include sheets of plain paper, thin paper, such as tracing paper, and OHP sheets that are used in, for example, electrophotographic copy machines and printers. The smoothness of the image surfaces after the fixing process may be increased by making the surfaces of the recording paper sheets 5 as smooth as possible. Accordingly, for example, sheets of coated paper obtained by coating the surfaces of plain paper with resin or the like and so-called cardboard paper, such as art paper for printing, having a relatively high basis weight may also be used.

A sheet transport path 56 is provided between the sheet feeding device 50 and the second transfer device 30. The sheet transport path 56 is constituted by one or more sheet transport roller pairs 53 and 54 that transport each recording paper sheet 5 fed from the sheet feeding device 50 to the second transfer position and a transport guide 55. The sheet transport roller pair 54 is disposed immediately in front of the second transfer position along the sheet transport path 56 and serves as, for example, a pair of rollers that adjust the time when the recording paper sheet 5 is transported (registration rollers). A sheet transport path 57 is provided between the second transfer device 30 and the fixing device 40. The recording paper sheet 5 fed from the second transfer device 30 after the second transfer process is transported to the fixing device 40 along the sheet transport path 57. A discharge transport path 59 is disposed near a paper discharge opening formed in the apparatus body 1*a* of the image forming apparatus 1. The discharge transport path 59 is provided with a paper discharge roller pair 59*a* that discharges the recording paper sheet 5 to a paper discharge portion 58, which is provided in an upper section of the apparatus body 1*a*, after the recording paper sheet 5 is subjected to the fixing process and transported from the fixing device 40 by an exit roller 36.

Referring to FIG. 1, a control device 200 performs centralized control of the image forming apparatus 1. The control device 200 includes a central processing unit (CPU), a read only memory (ROM), a random access memory (RAM), a bus that connects the CPU, ROM, etc., and a communication interface. All of these components are not illustrated. A communication unit 201 provides communication between the image forming apparatus 1 and an external device. An image processing unit 202 processes image information input through the communication unit 201.

Operation of Image Forming Apparatus

A basic image forming operation performed by the image forming apparatus 1 will now be described.

A full-color-mode operation for forming a full-color image by combining toner images of four colors (Y, M, C, and K) by using the four image forming devices 10 (Y, M, C, and K) will be described.

When the control device 200 of the image forming apparatus 1 receives command information of a request for a full-color image forming operation (printing) from, for example, a user interface (not shown) or a printer driver (not shown) through the communication unit 201, the four image forming devices 10 (Y, M, C, and K), the intermediate transfer device 20, the second transfer device 30, and the fixing device 40 are activated.

As illustrated in FIG. 1, in each of the image forming devices 10 (Y, M, C, and K), the photoconductor drum 11 rotates in the direction of arrow A, and the charging device 12 charges the surface of the photoconductor drum 11 to a certain potential of a certain polarity (negative in the first exemplary embodiment). Subsequently, the exposure device 13 irradiates the charged surface of the photoconductor drum 11 with light emitted on the basis of an image signal obtained by converting the image information input to the image forming apparatus 1 into components of the respective colors (Y, M, C, and K) with the image processing unit 202. Thus, an electrostatic latent image of the corresponding color having a certain potential difference is formed on the surface of the photoconductor drum 11.

Subsequently, the image forming devices 10 (Y, M, C, and K) develop the electrostatic latent images of the respective colors formed on the photoconductor drums 11 by supplying toners of the respective colors (Y, M, C, and K), which are charged to a certain polarity (negative polarity), from the developing rollers 141 and causing the toners to electrostatically adhere to the photoconductor drums 11. Thus, the electrostatic latent images of the respective colors formed on the photoconductor drums 11 are developed with the toners of the respective colors and made visible as toner images of the four colors (Y, M, C, and K).

Subsequently, when the toner images of the respective colors formed on the photoconductor drums 11 of the image forming devices 10 (Y, M, C, and K) reach the first transfer positions, the first transfer devices 15 (Y, M, C, and K) perform the first transfer process in which the toner images of the respective colors are successively transferred onto the intermediate transfer belt 21, which is included in the intermediate transfer device 20 and rotates in the direction of arrow B, in a superposed manner.

After the first transfer process, the drum cleaning device 16 of each of the image forming devices 10 (Y, M, C, and K) cleans the surface of the corresponding photoconductor drum 11 by scraping off deposits therefrom. Thus, the image forming devices 10 (Y, M, C, and K) are made ready for the next image forming operation.

Subsequently, the intermediate transfer belt 21 of the intermediate transfer device 20 rotates to carry and transport the toner images that have been transferred thereto in the first transfer process to the second transfer position. The sheet feeding device 50 feeds the recording paper sheet 5 to the sheet transport path 56 in accordance with the image forming operation. The sheet transport roller pair 54, which serves as a pair of registration rollers, feeds the recording paper sheet 5 toward the second transfer position along the sheet transport path 56 at the time corresponding to the transfer time.

The toner images on the intermediate transfer belt 21 are simultaneously transferred onto the recording paper sheet 5 in the second transfer process performed by the second transfer device 30 at the second transfer position. After the second transfer process, the belt cleaning device 28 of the intermediate transfer device 20 cleans the surface of the intermediate transfer belt 21 by removing residual toner and other deposits therefrom.

Subsequently, the recording paper sheet 5 to which the toner images have been transferred in the second transfer process is removed from the intermediate transfer belt 21 and transported to the fixing device 40 along the sheet transport path 57. The fixing device 40 causes the recording paper sheet 5 that has been subjected to the second transfer process to pass through the contact section between the heating rotating body 42 and the pressing rotating body 43 that rotate, and fixes the unfixed toner images to the recording paper sheet 5 by performing a necessary fixing process (heating and pressing). Finally, the recording paper sheet 5 that has been subjected to the fixing process is discharged to, for example, the paper discharge portion 58 in the upper section of the apparatus body 1*a* by the paper discharge roller pair 59*a*.

As a result of the above-described operation, the recording paper sheet 5 having a full-color image, which is formed by combining the toner images of the four colors, formed thereon is output.

Structure of Fixing Device

Figure 2:
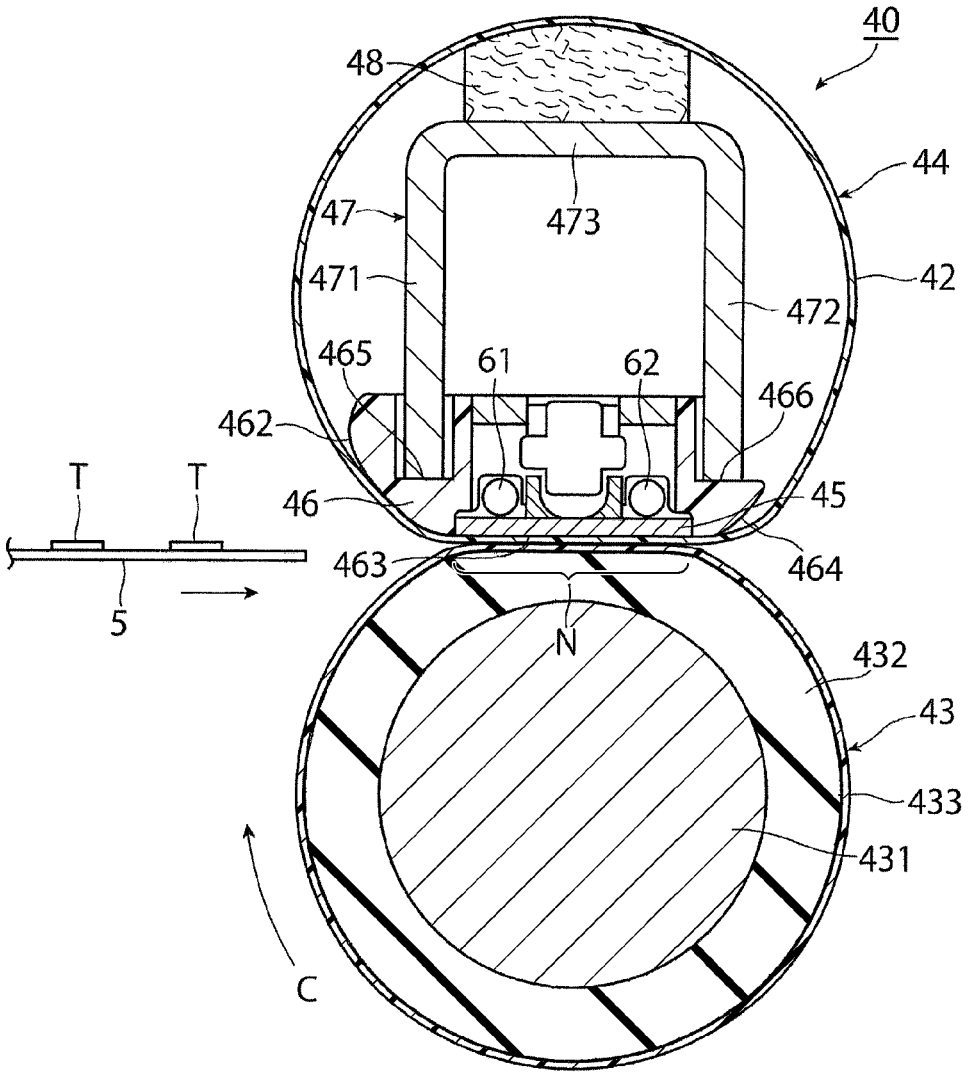
FIG. 2 is a sectional view illustrating the structure of the fixing device according to the first exemplary embodiment of the present disclosure.

FIG. 2 is a sectional view illustrating the structure of the fixing device 40 according to the first exemplary embodiment.

The fixing device 40 employs a so-called free belt nip system. As illustrated in FIG. 2, the fixing device 40 basically includes a heating unit 44 and the pressing roller 43. The heating unit 44 includes the heating belt 42, which is an example of a first rotating body and which is composed of a rotating endless belt. The pressing roller 43 is an example of a second rotating body, and is pressed against the heating unit 44. A fixing nip portion N is formed between the heating belt 42 and the pressing roller 43. The fixing nip portion N is a region through which the recording paper sheet 5, which is an example of a heating object, passes. The recording paper sheet 5 has an unfixed toner image T, which is an example of an unfixed image, formed thereon. The recording paper sheet 5 is transported in a transporting direction with the center thereof in a direction crossing the transporting direction serving as a reference (so-called center registration).

As illustrated in FIG. 2, the heating unit 44 includes the heating belt 42, a ceramic heater 45, a support member 46, a holding member 47, and a felt member 48. The ceramic heater 45, which is disposed inside the heating belt 42, is an example of a surface heater member that heats the heating belt 42. The support member 46, which is also disposed inside the heating belt 42, is an example of a support unit that supports the ceramic heater 45 so as to press the ceramic heater 45 against the surface of the pressing roller 43 with the heating belt 42 disposed therebetween. The holding member 47, which is also disposed inside the heating belt 42, is an example of a holding unit that holds the support member 46 so as to press the support member 46 toward the pressing roller 43. The felt member 48, which is also disposed inside the heating belt 42, is an example of a lubricant holding unit that holds lubricant applied to the inner peripheral surface of the heating belt 42.

As described below, it is not necessary that the ceramic heater 45, which is an example of a surface heater member, include a surface-shaped heater portion, and the ceramic heater 45 may instead include a linear heater portion as long as the bottom end surface of the ceramic heater 45 that heats the heating belt 42 is surface-shaped.

Figure 3:
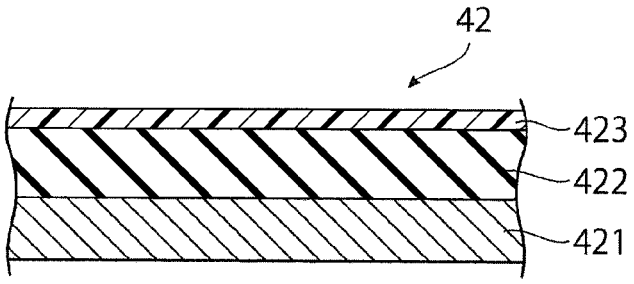
FIG. 3 is a sectional view illustrating the structure of a heating belt.

The heating belt 42 is made of a flexible material, and is formed as an endless belt having a thin-walled tubular shape before the heating belt 42 is attached. As illustrated in FIG. 3, the heating belt 42 includes a base material layer 421, an elastic layer 422 that covers a surface of the base material layer 421, and a release layer 423 that covers a surface of the elastic layer 422. It is not necessary that the heating belt 42 include all of the base material layer 421, the elastic layer 422, and the release layer 423, and the heating belt 42 may include only the base material layer 421 or only the base material layer 421 and the release layer 423. The base material layer 421 is made of a heat-resistant synthetic resin, such as polyimide, polyamide, or polyimideamide, or a metal, such as stainless steel, nickel, or copper, formed in a thin-walled shape. The elastic layer 422 is composed of an elastic body made of, for example, heat-resistant silicone rubber or fluorine rubber. The release layer 423 is made of, for example, perfluoroalkoxy alkane (PFA) or polytetrafluoroethylene (PTFE). The heating belt 42 may have a thickness of, for example, about 50 to 300 μm.

Figure 4:
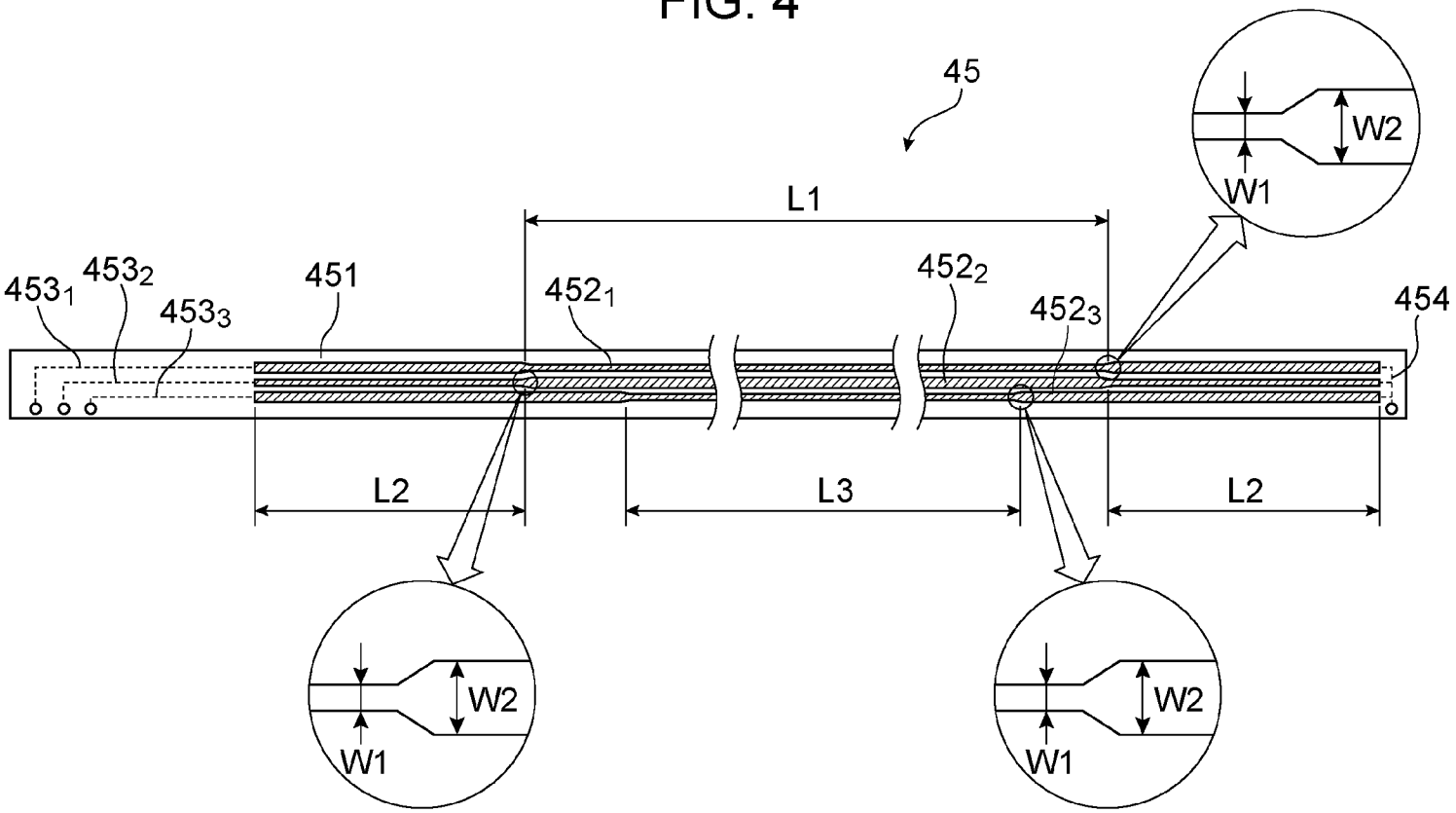
FIG. 4 is a plan view illustrating the structure of heater portions of a ceramic heater.
Figure 5:
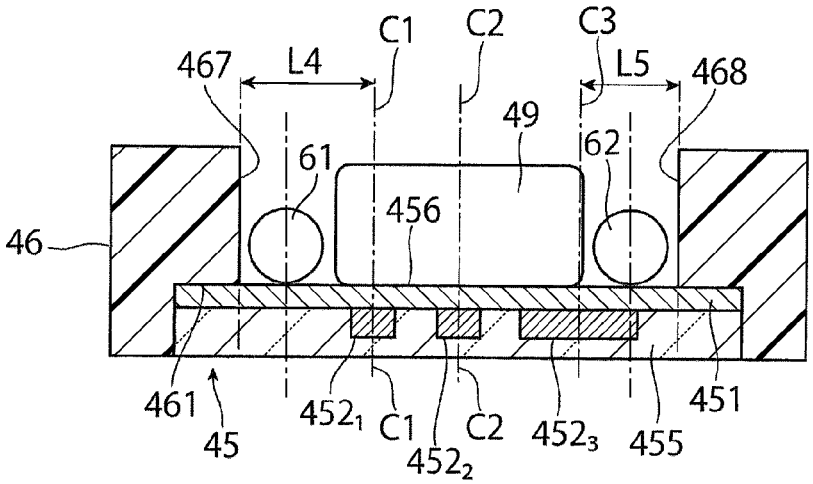
FIG. 5 is a sectional view illustrating the structure of a relevant part of the fixing device according to the first exemplary embodiment of the present disclosure.

As illustrated in FIGS. 4 and 5, the ceramic heater 45 includes a substrate 451 made of a ceramic; first to third heater portions $\mathbf{452}_1$ to $\mathbf{452}_3$ formed on a surface of the substrate 451 so as to extend linearly in a longitudinal direction; first to third electrodes $\mathbf{453}_1$ to $\mathbf{453}_3$ for individually supplying electricity to the first to third heater portions $\mathbf{452}_1$ to $\mathbf{452}_3$, respectively; a common electrode 454 that supplies electricity to the other end portions of the first to third heater portions $\mathbf{452}_1$ to $\mathbf{452}_3$; and a glass covering layer 455 that covers at least surfaces of the first to third heater portions $\mathbf{452}_1$ to $\mathbf{452}_3$.

As illustrated in FIG. 4, the first to third heater portions $\mathbf{452}_1$ to $\mathbf{452}_3$ are arranged parallel to each other in a width direction of the substrate 451. The first to third heater portions $\mathbf{452}_1$ to $\mathbf{452}_3$ are formed to have different heating regions in the longitudinal direction by changing the line width and/or thickness of the heating material that forms the first to third heater portions $\mathbf{452}_1$ to $\mathbf{452}_3$. The first to third heater portions $\mathbf{452}_1$ to $\mathbf{452}_3$ have the same length in the longitudinal direction.

The first heater portion $\mathbf{452}_1$ is formed of a heating material having a small line width and a high electrical resistance in a region centered on the center of the heating region in the longitudinal direction and having a length of L1 in the left-right direction, so that heat is generated in the central region of the heating region having the length L1. In regions on both sides of the region having the length L1, the heating material of the first heater portion $\mathbf{452}_1$ has a large line width and a small electrical resistance so that no heat or only a very small amount of heat is generated.

In contrast to the first heater portion $\mathbf{452}_1$, the second heater portion $\mathbf{452}_2$ is formed of a heating material having a small line width in regions other than the region centered on the center in the longitudinal direction and having the length L1 in the left-right direction, so that heat is generated in the regions other than the region centered on the center in the longitudinal direction and having the length L1 in the left-right direction. In the region having the length L1, the heating material of the second heater portion $\mathbf{452}_2$ has a large line width so that no heat or only a very small amount of heat is generated.

Unlike the first and second heater portion $\mathbf{452}_1$ and $\mathbf{452}_2$, the third heater portion $\mathbf{452}_3$ is formed of a heating material having a small line width and a high electrical resistance in a region centered on the center of the heating region in the longitudinal direction and having a length of L3 in the left-right direction, so that heat is generated in the central region of the heating region having the length L3. In regions on both sides of the region having the length L3, the heating material of the third heater portion $\mathbf{452}_3$ has a large line width and a small electrical resistance so that no heat or only a very small amount of heat is generated.

Figure 6:
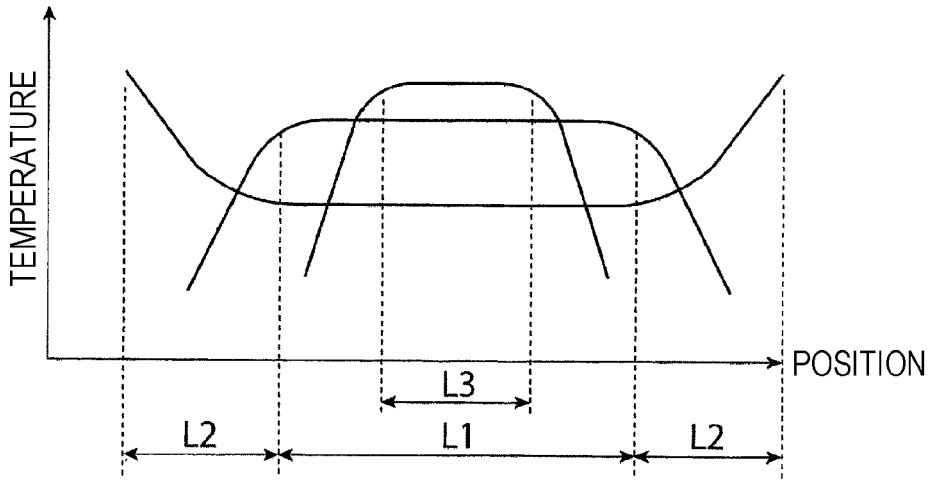
FIG. 6 is a graph showing the heating temperature of the ceramic heater.

FIG. 6 is a schematic graph showing the heating temperatures of the first to third heater portions $\mathbf{452}_1$ to $\mathbf{452}_3$.

Referring to FIG. 6, the first heater portion $\mathbf{452}_1$ generates heat so that the temperature thereof reaches a preset temperature in the region centered on the center of the heating region in the longitudinal direction and having the length L1 in the left-right direction. The second heater portion $\mathbf{452}_2$ generates heat so that the temperature thereof reaches a preset temperature in regions other than the region centered on the center in the longitudinal direction and having the length L1 in the left-right direction. The third heater portion $\mathbf{452}_3$ generates heat so that the temperature thereof reaches a preset temperature in the region centered on the center of the heating region in the longitudinal direction and having the length L3 in the left-right direction.

Referring to FIG. 4, the first heater portion $\mathbf{452}_1$ is used in a heating and fixing process performed on the recording paper sheet 5 when the recording paper sheet 5 has the length L1, which is an intermediate length, in the direction crossing the transporting direction.

The second heater portion $\mathbf{452}_2$ is used together with the first heater portion $\mathbf{452}_1$ in the heating and fixing process performed on the recording paper sheet 5 when the recording paper sheet 5 has a large size and the length thereof is L1+2·L2 in the direction crossing the transporting direction.

The third heater portion $\mathbf{452}_3$ is used in the heating and fixing process performed on the recording paper sheet 5 when the recording paper sheet 5 has the smallest size and the length thereof is L3 in the direction crossing the transporting direction.

Referring to FIG. 2, the holding member 47 is composed of, for example, a plate member made of a metal, such as stainless steel, aluminum, or steel. The holding member 47 is substantially angular U-shaped in cross section and includes vertical plate portions 471 and 472 and a horizontal plate portion 473. The vertical plate portions 471 and 472 are disposed to extend substantially perpendicularly to a surface of the ceramic heater 45 at locations upstream and downstream of the fixing nip portion N in the direction in which the heating belt 42 rotates. The horizontal plate portion 473 is disposed to extend horizontally so as to connect proximal end portions of the vertical plate portions 471 and 472.

Referring to FIG. 5, the temperature of the heating belt 42 in the fixing nip portion N is detected by temperature sensors 49 disposed in contact with a surface of the ceramic heater 45 at a side opposite to the side adjacent to the fixing nip portion N. As described above, the ceramic heater 45 includes the first to third heater portions $\mathbf{452}_1$ to $\mathbf{452}_3$ having different heating regions in the longitudinal direction. Therefore, plural temperature sensors 49 (for example, three temperature sensors 49) that correspond to the first to third heater portions $\mathbf{452}_1$ to $\mathbf{452}_3$ are arranged in the longitudinal direction of the ceramic heater 45. A temperature control circuit (not shown) controls energization of each of the first to third heater portions $\mathbf{452}_1$ to $\mathbf{452}_3$ of the ceramic heater 45 based on the detection result obtained by the temperature sensors 49. Thus, the heating belt 42 is heated to a certain fixing temperature (for example, about 200° C.) in the fixing nip portion N in accordance with the size of the recording paper sheet 5.

Referring to FIG. 2, the support member 46 is formed of, for example, a heat-resistant synthetic resin that is integrally molded into a certain shape by, for example, injection molding. The heat-resistant synthetic resin may be, for example, liquid crystal polymer (LCP), polyether ether ketone (PEEK), polyphenylene sulfide (PPS), polyether sulfone (PES), polyamide-imide (PAI), polytetrafluoroethylene (PTFE), polychlorotrifluoroethylene (PCTFE), polyvinylidene fluoride (PVDF), or a composite material thereof.

The support member 46 has a supporting recess 461 that supports the ceramic heater 45 so as to press the ceramic heater 45 against the pressing roller 43 with the heating belt 42 disposed therebetween in the fixing nip portion N. The supporting recess 461 has an elongated rectangular shape that corresponds to the planar shape of the ceramic heater 45. The length of the support member 46 is greater than the overall length of the heating belt 42 in the longitudinal direction.

As illustrated in FIG. 2, the support member 46 includes a first guide portion 462 at a location upstream of the fixing nip portion N in the direction in which the heating belt 42 rotates. The first guide portion 462 has a curved shape in cross section and guides the heating belt 42 to the fixing nip portion N. The support member 46 has a flat bottom end surface 463. The support member 46 also includes a bent portion 464 at a location downstream of the fixing nip portion N in the direction in which the heating belt 42 rotates. The bent portion 464 is bent further inward than the heating belt 42 having the curved shape so that the bent portion 464 is not in contact with the heating belt 42 that has passed the fixing nip portion N.

As illustrated in FIG. 2, the support member 46 includes contact portions 465 and 466 that are in contact with distal end portions of the vertical plate portions 471 and 472 of the holding member 47 at a side opposite to the side adjacent to the fixing nip portion N.

As illustrated in FIG. 2, the pressing roller 43 includes a core bar 431, an elastic layer 432, and a release layer 433. The core bar 431 has a solid or hollow cylindrical shape and is made of a metal, such as stainless steel, aluminum, or iron (thin-walled high tensile strength steel pipe). The elastic layer 432 is composed of a heat-resistant elastic body made of, for example, silicone rubber or fluorine rubber with which the outer periphery of the core bar 431 is relatively thickly coated. The release layer 433 is made of, for example, polytetrafluoroethylene (PTFE) or perfluoroalkoxy alkane (PFA) with which the surface of the elastic layer 432 is thinly coated. A heating unit (heating source) composed of, for example, a halogen lamp, may be disposed in the pressing roller 43 as necessary.

The end portions of the pressing roller 43 in the longitudinal direction (axial direction) thereof are rotatably supported by bearing members provided on a frame of a device housing (not shown) of the fixing device 40. The pressing roller 43 has a drive gear (not shown) attached to one end portion of the core bar 431, which serves as a rotating shaft, in the axial direction, and is rotated at a certain speed in the direction of arrow C together with the drive gear by a driving device. The heating belt 42 is pressed against the pressing roller 43 that is rotated, and is thereby rotated.

Referring to FIG. 2, the fixing device 40 having the above-described structure applies heat and pressure to the recording paper sheet 5, which is transported with the center thereof in the direction crossing the transporting direction serving as a reference (so-called center registration), so that the unfixed toner image T is fixed to the recording paper sheet 5. The fixing device 40 may, for example, successively perform the fixing operation on small recording paper sheets 5 having a relatively short length in the longitudinal direction of the heating belt 42. In such a case, even though the heating operation of the first to third heater portions $\mathbf{452}_1$ to $\mathbf{452}_3$ is switched depending on the size of the recording paper sheets 5, the size of the recording paper sheets 5 may differ from that of the heating region of the first to third heater portions $\mathbf{452}_1$ to $\mathbf{452}_3$, and heat of the heating belt 42 is not absorbed by the recording paper sheets 5 in paper non-passing regions at both ends of the heating belt 42 in the longitudinal direction. Therefore, the temperature tends to increase in the paper non-passing regions.

To reduce the temperature increase at the ends of the heating unit in the longitudinal direction, a fixing device according to the related art includes a highly heat-conductive member provided on a heating body at a side opposite to a contact surface that is in contact with a fixing film (see, for example, Japanese Unexamined Patent Application Publication No. 5-289555).

However, when the highly heat-conductive member is provided on the heating body at a side opposite to the contact surface that is in contact with the fixing film, the heat capacity of the heating body is increased due to the highly heat-conductive member when the fixing operation is started. Therefore, the time required to heat the heating body to a certain fixing start temperature, that is, a warm-up time, is increased.

Therefore, according to the first exemplary embodiment, to reduce both the temperature increase at the ends of the surface heater unit in the longitudinal direction and the temperature increase time after the start of the heating process compared to when the highly heat-conductive member is provided on the surface heater unit over the entire area thereof at a side opposite to the contact surface that is in contact with the heating object, a heat conducting unit having the following structure is provided. The heat conducting unit is disposed in contact with a surface of the surface heater unit at a side opposite to a side adjacent to the heating object in a region between the center of a heater portion of the surface heater unit in a direction crossing the longitudinal direction and the support unit. The heat conducting unit promotes heat conduction in the longitudinal direction of the surface heater unit.

More specifically, as illustrated in FIG. 2, the fixing device 40 according to the first exemplary embodiment includes two heat pipes 61 and 62 having a relatively small outer diameter on the back side of the ceramic heater 45 as examples of the heat conducting unit.

Figure 7:
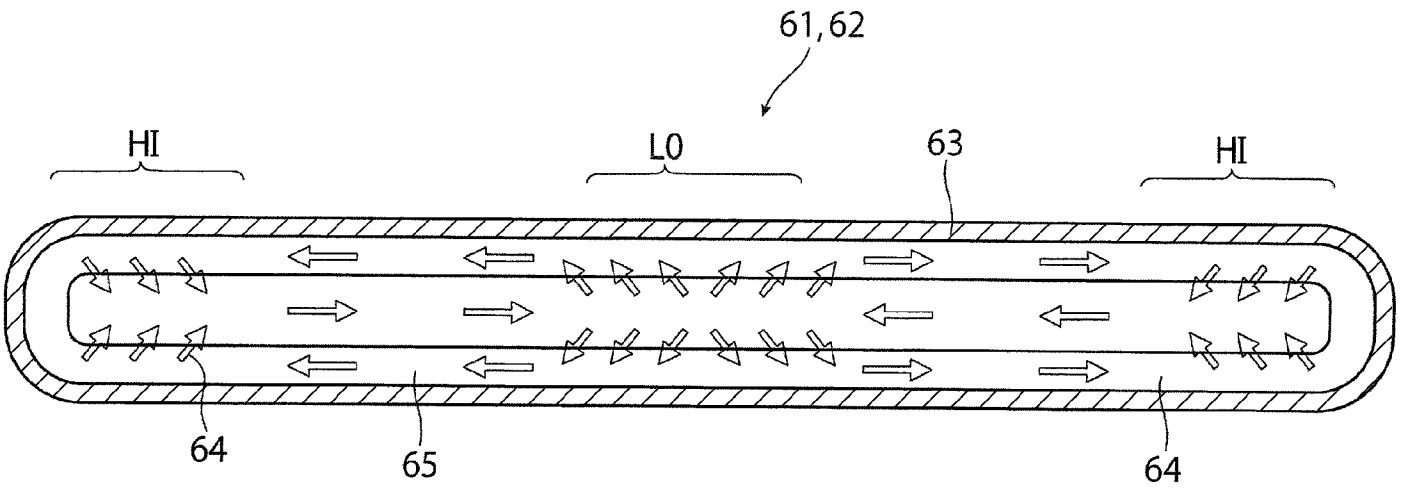
FIG. 7 is a sectional view illustrating the structure of a heat pipe.

As illustrated in FIG. 7, the heat pipes 61 and 62 each include a pipe body 63, working fluid 64, and a wick 65. The pipe body 63 is made of a metal having a relatively high thermal conductivity, such as copper, stainless steel, or aluminum, and has a hollow cylindrical shape that is closed at both ends thereof and is airtight. The working fluid 64 is a liquid, such as water, sealed in the pipe body 63. The wick 65 is provided on the inner peripheral surface of the pipe body 63 so as to extend over the entire length of the pipe body 63. The wick 65 is an example of a working-fluid transport unit that transports the working fluid 64 in a liquefied state in the longitudinal direction of the pipe body 63 by capillarity. The wick 65 may be, for example, thin copper wires, sintered metal, or a wire gauze.

The heat pipes 61 and 62 each operate such that the working fluid 64 sealed therein is vaporized in regions HI where the temperature is relatively high in the longitudinal direction thereof. Due to the pressure increase caused by the vaporization of the working fluid 64, the vaporized working fluid 64 is moved toward a region LO where the temperature and pressure are relatively low in the longitudinal direction of the pipe body 63. In each of the heat pipes 61 and 62, the working fluid 64 in the vaporized state is liquefied in the region where the temperature is relatively low in the longitudinal direction. The liquefied working fluid 64 is moved toward the regions HI where the temperature is relatively high in the longitudinal direction of the pipe body 63 by the capillarity of the wick 65.

The heat pipes 61 and 62 each repeat the above-described operation to transmit heat from the regions HI where the temperature is relatively high to the region LO where the temperature is relatively low in the longitudinal direction of the pipe body 63 so that a significantly greater amount of heat is quickly transmitted in the longitudinal direction than in, for example, normal heat conduction.

In the first exemplary embodiment, each of the heat pipes 61 and 62 is a very thin heat pipe in which the pipe body 63 has an outer diameter of 2 to 3 mm. The heat pipes 61 and 62 may have a thermal conductivity of greater than or equal to $10^4$ (W/m·K). The outer diameter of the heat pipes 61 and 62 is not limited to 2 to 3 mm, and may, of course, be greater. When the outer diameter of the heat pipes 61 and 62 is as small as 2 to 3 mm, the heat pipes 61 and 62 have small heat capacities.

As illustrated in FIG. 5, the heat pipes 61 and 62 are disposed in contact with a back surface 456 of the ceramic heater 45 at a side opposite to the side adjacent the pressing roller 43 in regions between the centers C1 to C3 of the first to third heater portions $\mathbf{452}_1$ to $\mathbf{452}_3$ in the direction crossing the longitudinal direction and the inner wall surfaces 467 and 468 of the support member 46.

More specifically, the first heat pipe 61 is disposed on the back surface 456 of the ceramic heater 45 at a side opposite to the side adjacent to the pressing roller 43 in the region between the center C1 of the first heater portion $\mathbf{452}_1$ in the direction crossing the longitudinal direction and one inner wall surface 467 of the support member 46 such that the center line of the first heat pipe 61 is located within the distance L4 between the center C1 of the first heater portion $\mathbf{452}_1$ in the direction crossing the longitudinal direction and the inner wall surface 467 of the support member 46. To reduce the temperature increase of the support member 46, the first heat pipe 61 may be disposed in contact with the support member 46.

The second heat pipe 62 is disposed on the back surface 456 of the ceramic heater 45 at a side opposite to the side adjacent to the pressing roller 43 in the region between the center C3 of the third heater portion $\mathbf{452}_3$ in the direction crossing the longitudinal direction and the other inner wall surface 468 of the support member 46 such that the center line of the second heat pipe 62 is located within the distance L5 between the center C3 of the third heater portion $\mathbf{452}_3$ in the direction crossing the longitudinal direction and the inner wall surface 468 of the support member 46. To reduce the temperature increase of the support member 46, the second heat pipe 62 may be disposed in contact with the support member 46.

In the illustrated example, the second heat pipe 62 partially overlaps the third heater portion $\mathbf{452}_3$ of the ceramic heater 45. However, as described above, the ceramic heater 45 is configured such that no heat or only a very small amount of heat is generated in regions where the line width is large. Therefore, no heat or only a very small amount of heat is directly transmitted from the third heater portion $\mathbf{452}_3$ to the second heat pipe 62.

Operation of Fixing Device

The fixing device according to the first exemplary embodiment has the configuration described below to reduce both the temperature increase at the ends of the surface heater unit in the longitudinal direction and the temperature increase time after the start of the heating process compared to when a highly heat-conductive member is provided on the surface heater unit over the entire area thereof at a side opposite to the contact surface that is in contact with the heating object.

Referring to FIG. 2, the fixing device according to the first exemplary embodiment is configured such that at least one or more of the first to third heater portions $\mathbf{452}_1$ to $\mathbf{452}_3$ of the ceramic heater generate heat to heat the heating belt 42.

The heating belt 42 that is heated rotates together with the pressing roller 43 that rotates in the direction of arrow C in FIG. 2, and performs the fixing process by applying heat and pressure to the recording paper sheet 5 holding the unfixed toner image T in the fixing nip portion N.

Referring to FIG. 5, the heating temperature of the heating belt 42 is detected by the temperature sensors 49 arranged in the longitudinal direction along the back surface 456 of the ceramic heater 45, and a temperature control device (not shown) controls energization of at least one or more of the first to third heater portions $\mathbf{452}_1$ to $\mathbf{452}_3$.

Figure 8:
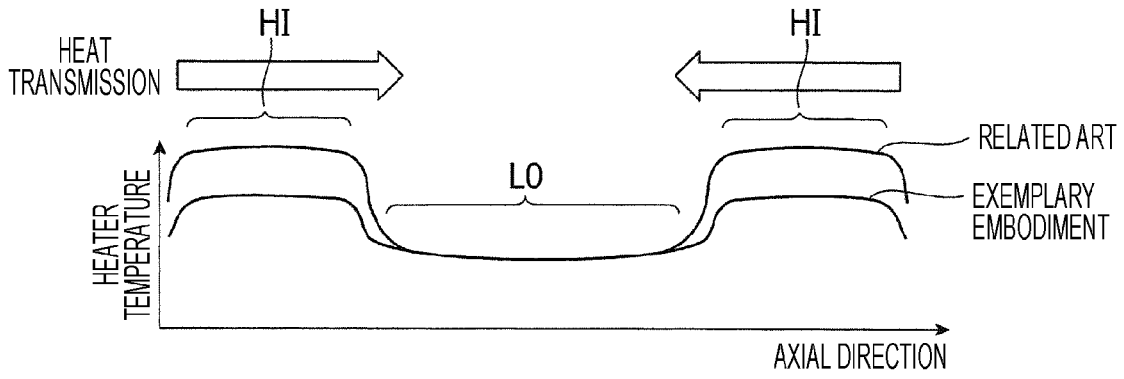
FIG. 8 is a graph showing the effect of the fixing device according to the first exemplary embodiment of the present disclosure.

The fixing device 40 may, for example, successively perform the fixing operation on small recording paper sheets 5 having a relatively short length in the longitudinal direction of the heating belt 42. In such a case, even though the heating operation of the first to third heater portions $\mathbf{452}_1$ to $\mathbf{452}_3$ is switched depending on the size of the recording paper sheets 5, the size of the recording paper sheets 5 may differ from that of the heating region of the first to third heater portions $\mathbf{452}_1$ to $\mathbf{452}_3$, and heat of the heating belt 42 is not absorbed by the recording paper sheets 5 in paper non-passing regions at both ends of the heating belt 42 in the longitudinal direction. Therefore, as illustrated in FIG. 8, the temperature tends to increase in the paper non-passing regions.

As illustrated in FIG. 5, the fixing device 40 of the first exemplary embodiment is structured such that the first and second heat pipes 61 and 62 are provided in contact with the back surface 456 of the ceramic heater 45 over the entire length thereof in the longitudinal direction.

When, for example, the fixing device 40 successively performs the fixing operation on small recording paper sheets 5 having a relatively short length in the longitudinal direction of the heating belt 42, heat is not absorbed by the recording paper sheets 5 in the paper non-passing regions of the ceramic heater 45. Therefore, the temperature tends to increase in the paper non-passing regions.

Accordingly, heat is transmitted from the paper non-passing regions of the ceramic heater 45 to the first and second heat pipes 61 and 62, and then from the paper non-passing regions HI, where the temperature is relatively high, at both ends to the central paper passing region LO, where the temperature is relatively low, due to the high thermal conductivity of the first and second heat pipes 61 and 62.

Accordingly, as illustrated in FIG. 8, the temperature increase in the paper non-passing regions of the ceramic heater 45 at both ends thereof is less than when the first and second heat pipes 61 and 62 are not provided. As a result, thermal damage to the support member 46 made of a heat-resistant synthetic resin due to the temperature increase at both ends is reduced or prevented.

The first and second heat pipes 61 and 62 are disposed on the back surface 456 of the ceramic heater 45 at a side opposite to the side adjacent to the pressing roller 43, and are respectively in a region between the center C1 of the first heater portion $452_1$ in the direction crossing the longitudinal direction and the inner wall surface 467 of the support member 46 and a region between the center C3 of the third heater portion $452_3$ in the direction crossing the longitudinal direction and the inner wall surface 468 of the support member 46.

Accordingly, the first and second heat pipes 61 and 62 have an outer diameter that is as small as 2 to 3 mm, and do not have high heat capacities although the heat transfer efficiency thereof in the longitudinal direction is high.

Figure 9:
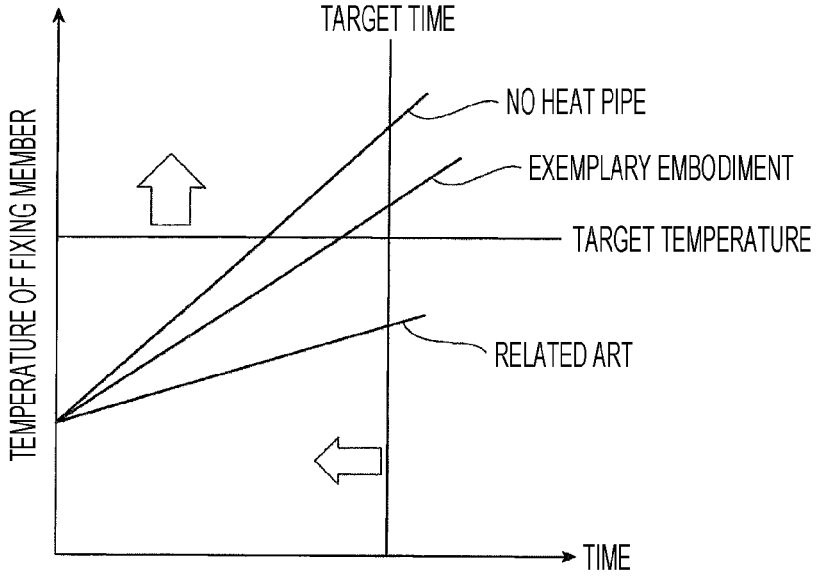
FIG. 9 is another graph showing the effect of the fixing device according to the first exemplary embodiment of the present disclosure.

Therefore, as illustrated in FIG. 9, the first and second heat pipes 61 and 62 may be installed in the fixing device 40 without causing a large increase in the warm-up time required to increase the temperature of the ceramic heater 45 to a certain fixing temperature immediately after the start of energization of, for example, the first heater portion $452_1$ when the image forming operation (fixing operation) is started. Thus, the temperature increase at the ends of the ceramic heater 45 in the longitudinal direction and the temperature increase time after the start of the heating process may both be reduced.

In contrast, a fixing device 40 according to the related art is structured such that a heat pipe is provided on the back surface of a surface heater member over the entire area thereof. Therefore, the heat pipe has a high heat capacity, and the warm-up time required to increase the temperature to a certain fixing temperature is increased.

Second Exemplary Embodiment

FIGS. 10A to 10D illustrate the structures of relevant parts of fixing devices according to a second exemplary embodiment of the present disclosure. In FIGS. 10A to 10D, the heater portions 452 of the ceramic heaters 45 are illustrated to be on the back surfaces of the ceramic heaters 45 for convenience. However, similar to the above-described first exemplary embodiment, the heater portions 452 of the ceramic heaters 45 are provided on the lower surfaces of the substrates 451 of the ceramic heaters 45.

Figure 10A:
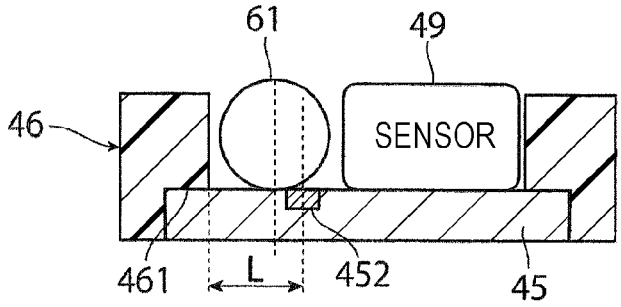
FIGS. 10A to 10D illustrate the structures of fixing devices according to a second exemplary embodiment of the present disclosure.

The fixing device 40 according to the second exemplary embodiment illustrated in FIG. 10A is structured such that the ceramic heater 45 includes only one heater portion 452. The heater portion 452 of the ceramic heater 45 is disposed near one end portion of the substrate 451 in the width direction thereof. The heater portion 452 of the ceramic heater 45 is disposed such that the center thereof in the direction crossing the longitudinal direction is at a distance of L from an inner end portion of the support member 46 in the width direction, and one heat pipe 61 is disposed in contact with the ceramic heater 45 within the distance L. The heat pipe 61 has an outer diameter of about 3 to 5 mm.

Figure 10B:
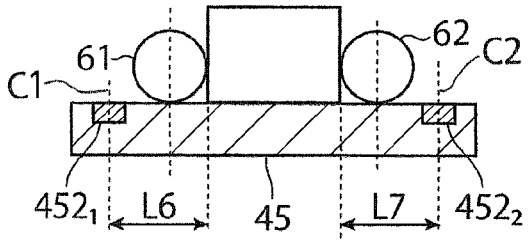

The fixing device 40 according to the second exemplary embodiment illustrated in FIG. 10B is structured such that the ceramic heater 45 includes two heater portions $452_1$ and $452_2$. The two heater portions $452_1$ and $452_2$ of the ceramic heater 45 are disposed near respective end portions of the substrate 451 in the width direction thereof. The heater portions $452_1$ and $452_2$ of the ceramic heater 45 are disposed such that the centers C1 and C2 thereof in the direction crossing the longitudinal direction are at distances of L6 and L7, respectively, from the inner end portions of the support member 46 in the width direction, and two heat pipes 61 and 62 are disposed in contact with the support member 46 within the distances L6 and L7, respectively. The heat pipes 61 and 62 have an outer diameter of about 3 to 5 mm.

Figure 10C:
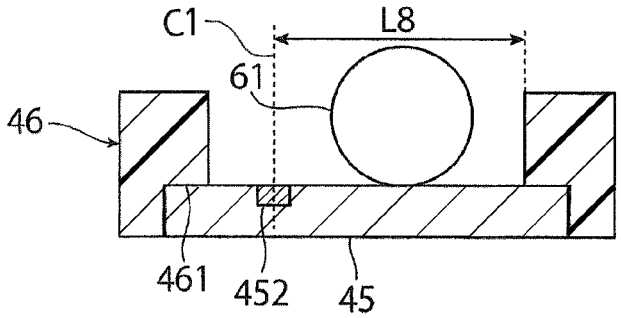

The fixing device 40 according to the second exemplary embodiment illustrated in FIG. 10C is structured such that the ceramic heater 45 includes one heater portion 452. The heater portion 452 of the ceramic heater 45 is disposed near one end portion of the substrate 451 in the width direction thereof. The heater portion 452 of the ceramic heater 45 is disposed such that the center C1 thereof in the direction crossing the longitudinal direction is at a distance of L8 from an inner end portion of the support member 46 in the width direction, and one heat pipe 61 is disposed within the distance L8. The heat pipe 61 has an outer diameter of about 5 mm.

Figure 10D:
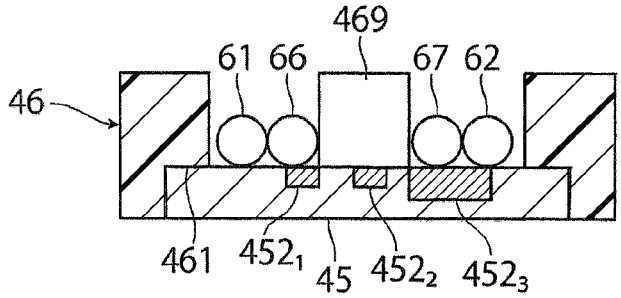

The fixing device 40 according to the second exemplary embodiment illustrated in FIG. 10D basically has a structure similar to that of the first exemplary embodiment, and the support member 46 additionally includes a support portion 469 that supports a central portion of the ceramic heater 45 at the back surface 456. In addition to the first and second heat pipes 61 and 62, third and fourth heat pipes 66 and 67 are respectively provided between the first heat pipe 61 and the support portion 469 of the support member 46 and between the second heat pipe 62 and the support portion 469 of the support member 46.

Figure 11:
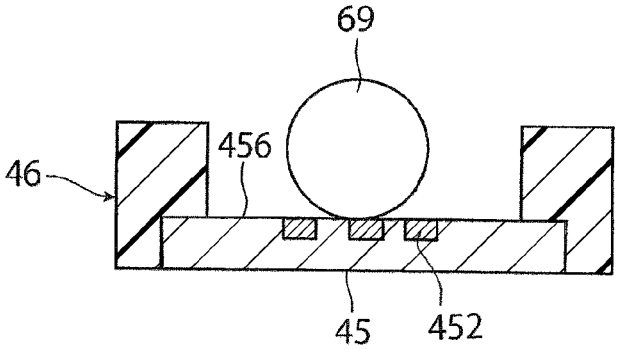
FIG. 11 illustrates the structure of a relevant part of a fixing device according to a comparative example.

FIG. 11 illustrates a comparative example for the exemplary embodiments of the present disclosure. Referring to FIG. 11, the ceramic heater 45 includes three heater portions 452, and a single heat pipe 69 having a relatively large outer diameter is disposed in contact with the back surface 456 of the ceramic heater 45.

According to this comparative example, as illustrated in FIG. 11, the heat pipe 69 is not disposed between the heater portions 452 of the ceramic heater 45 and the inner surfaces of the support member 46. Therefore, transmission of heat from the heater portions 452 of the ceramic heater 45 to the support member 46 cannot be reduced by the heat pipe 69.

Other structures and operations are similar to those of the first exemplary embodiment, and description thereof is thus omitted.

Although examples in which the surface heater unit is a ceramic heater are described in the above exemplary embodiments, the surface heater unit is not limited to a ceramic heater, and may be any heater unit as long as heat is generated literally along a surface in the fixing nip portion N.

In addition, although examples in which the pressing unit is a pressing roller are described in the above exemplary embodiments, the pressing unit may instead be a pressing belt.

Although an electrophotographic image forming apparatus is described above, application of the present disclosure is not limited to an electrophotographic image forming apparatus. The present disclosure may also be applied to, for example, an inkjet image forming apparatus including a component that comes into contact with a paper sheet transported while an image formed of an undried layer of ink (unfixed ink image) is provided thereon to fix the unfixed ink image to the paper sheet.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A heating device comprising:

a surface heater unit including a heater portion that generates heat in a region extending in a longitudinal direction, the surface heater unit heating a heating object;

a support unit that supports the surface heater unit; and a heat conducting unit disposed in contact with a surface of the surface heater unit at a side opposite to a side adjacent to the heating object in a region between a center of the heater portion in a direction crossing the longitudinal direction and the support unit.

2. The heating device according to claim 1, wherein the heat conducting unit is disposed near the support unit in a region between the center of the heater portion in the direction crossing the longitudinal direction and an end portion of the support unit that is adjacent to the heater portion.

3. The heating device according to claim 2, wherein the heat conducting unit is disposed in contact with the support unit.

4. The heating device according to claim 1, wherein the heat conducting unit is disposed on each side of the heater portion in the direction crossing the longitudinal direction.

5. The heating device according to claim 4, wherein the heat conducting unit includes a heat pipe having a circular shape with an outer diameter of less than or equal to 3 mm in cross section.

6. The heating device according to claim 1, wherein the heater portion of the surface heater unit is one of a plurality of heater portions arranged in the direction crossing the longitudinal direction.

7. The heating device according to claim 6, wherein the heat conducting unit comprises a plurality of heat conducting units that correspond to the heater portions disposed at both ends in the direction crossing the longitudinal direction.

8. A fixing device comprising:

a first rotating body that rotates and in which a heating unit is disposed to oppose a region through which a recording medium holding a toner image passes; and a second rotating body that rotates while pressing the recording medium toward the heating unit of the first rotating body, wherein the heating device according to claim 1 is used as the heating unit.

9. An image forming apparatus comprising:

an image forming unit that forms a toner image on a recording medium; and a fixing unit that fixes the toner image formed on the recording medium, wherein the fixing device according to claim 8 is used as the fixing unit.

* * * * *